United States Patent [19]

Eadie et al.

[11] 4,185,449

[45] Jan. 29, 1980

[54] TRAVELLERS FOR RING SPINNING MACHINES

[75] Inventors: Brian K. M. Eadie, Brookfield; William H. C. Parker, Glasgow; William A. White, Newton Nearns, all of Scotland

[73] Assignee: Eadie Bros. & Co., Limited, Victoria Works, Scotland

[21] Appl. No.: 901,218

[22] Filed: Apr. 28, 1978

[30] Foreign Application Priority Data

May 14, 1977 [GB] United Kingdom ..... 20350/77

[51] Int. Cl.[2] ..... D01H 7/60

[52] U.S. Cl. ..... 57/125

[58] Field of Search ..... 57/119–126

[56] References Cited

U.S. PATENT DOCUMENTS

| | | | |
|---|---|---|---|
| 1,226,661 | 5/1917 | Hine | 57/125 X |
| 1,604,929 | 10/1926 | Merrill | 57/125 X |
| 1,880,084 | 9/1932 | Gilligan | 57/125 X |
| 2,132,261 | 10/1938 | Fillinger | 57/125 X |
| 2,413,930 | 1/1947 | Smith | 57/125 X |
| 2,461,546 | 2/1949 | Herr | 57/120 |
| 3,159,963 | 12/1964 | Zakharov | 57/125 X |

FOREIGN PATENT DOCUMENTS

| | | | |
|---|---|---|---|
| 422324 | 1/1935 | United Kingdom | 57/125 |

*Primary Examiner*—John Petrakes

*Attorney, Agent, or Firm*—Norris & Bateman

[57] ABSTRACT

An integral traveller for ring spinning machines formed with two parallel limbs meeting at an apex at an included angle of 110°–120° to the horizontal with the apex symmetrical between the limbs and one limb being formed with an inturned portion for engagement in use with a shoulder on the outer surface of the ring.

3 Claims, 6 Drawing Figures

TRAVELLERS FOR RING SPINNING MACHINES

This invention relates to improvements in travellers for ring spinning machines.

According to the invention an integral traveller for ring spinning machines comprises two parallel limbs meeting at an apex at an included angle in the range of 110°-120° to the horizontal, the apex being symmetrical between the two parallel limbs and an inturned portion on the end of one limb for engagement, in use, with a shoulder on the outer surface of the ring.

In known rings the clearance between the yarn, as it bears on the traveller and the top of the ring is minimal, and in practice this has limited the application of this type of ring and traveller to spinning processes in which the lack of such clearance is not deleterious either to the efficiency of the process in terms of end breakages or to the quality of yarns produced in terms of damage to yarn caused by contact with the ring top.

Travellers of the known type comprise a continuously arcuate head portion joining straight inner and outer limbs, the outer limb being bent perpendicularly inward to form a lip engaging a shoulder on the outer surface of the ring.

The invention will be described with reference to the accompanying drawings.

Figure 1:
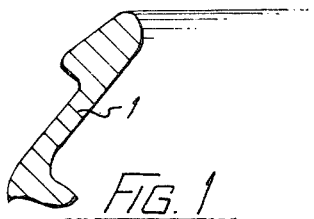
FIG. 1 is a section of part of a spinning ring.
Figure 2:
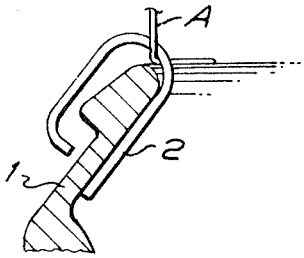
FIG. 2 is a section of the ring with a known traveller therein.

FIGS. 1-2 illustrate a known ring 1 and traveller 2, FIG. 2 showing the traveller in the running position with yarn passing through the traveller. The traveller of FIG. 2 is that disclosed in the patent to Zakharov U.S. Pat. No. 3,159,963.

In the present invention, (FIG. 3) the upper part of the continuously arcuate head portion of the traveller is replaced by a traveller comprising two straight parallel limbs, 3*a*, 3*b* respectively and joined at one end by a head comprising two oppositely uniformly inclined converging straight sections 3*c* and 3*d* meeting at an apex 4 with an included angle between 110°-120°, preferably of substantially 115°, to the horizontal between them, this apex being symmetrically formed with respect to the projected parallel limbs 3*a*, 3*b*. The apex 4 is not a sharp point but takes the form of an arcuate portion 5 of small radius of curvature joining the two aforesaid straight head sections 3*c* and 3*d*. Also the ends of the head may be joined to the links by curved transition sections 3*e* and 3*f* shown in FIG. 3. In this form the traveller may be constructed from metal or plastics material, the cross sectional shape of the traveller being any of those commonly used for spinning travellers of other types, but more commonly of round section metal wire.

Figure 3:
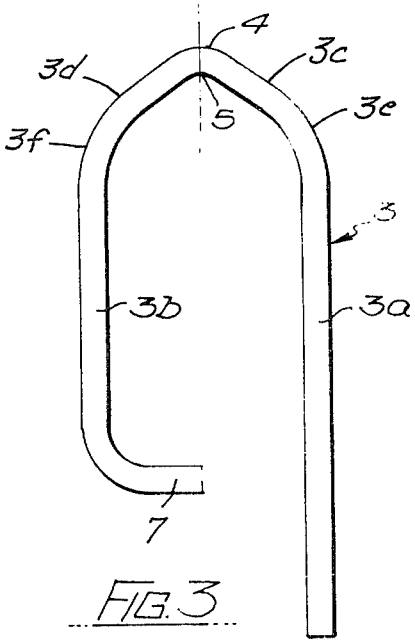
FIG. 3 is an elevation of a traveller in accordance with the invention.
Figure 4:
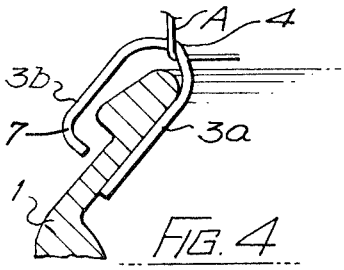
FIG. 4 is a section of the traveller shown in FIG. 3 on a ring.

As shown in FIGS. 3 and 4, the shorter limb 3*b* of the traveller is formed with an inturned end portion 7 for engagement in use with a shoulder in the outer surface of ring 1. As shown in FIG. 3 the symmetrically located apex 4 is substantially midway between parallel planes containing limbs 3*a* and 3*b*.

When the above described traveller of FIGS. 3 and 4 is in use, the yarn is guided into the groove 5 formed by the two straight portions in the head and bears on the traveller at the arcuate portion at the apex. The result is that the clearance between yarn and ring top is increased to the extent that spinning can take place under conditions not possible with the previously available travellers.

Figure 5:
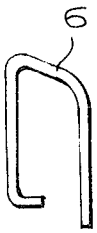
FIGS. 5 and 6 are side elevational views illustrating shapes of travellers which would not compy with the required conditions.
Figure 6:
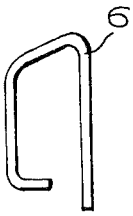

FIGS. 5 and 6 are presented in the drawing to illustrate that travellers not having the claimed symmetrical apex according to FIG. 3 will not accomplish the invention.

FIGS. 5 and 6 show travellers wherein an apex is formed between one side or the other of the head and the adjacent parallel limb. In the FIG. 5 version the travellers would rock about an axis coinciding with the inner limb of the traveller and run in such a way that the outer limb of the traveller would be in objectionable contact with the outside of the ring, while in the FIG. 6 version as in Zakharov the traveller would run in such a way that the yarn would be habitually trapped between the traveller apex and the top of the ring.

What we claim is:

1. An integral traveller for ring spinning machines comprising two parallel limbs joined at one end by a head symmetrically disposed between and with respect to said limbs and comprising two oppositely inclined converging straight sections meeting in single bearing surface means for yarn passing through said traveller consisting of an apex having an included angle in the range of about 110° to 120°, and there being an inturned portion on the other end of one limb for engagement, in use, with a shoulder on the outer surface of said ring.

2. The traveller defined in claim 1 wherein said apex is a radius between said straight head sections.

3. The traveller defined in claim 1, wherein said included angle is about 115°.

* * * * *